US006866054B1

(12) United States Patent
Collins

(10) Patent No.: US 6,866,054 B1
(45) Date of Patent: Mar. 15, 2005

(54) PORTABLE TABLE TOP TENT

(76) Inventor: Judith E Collins, 4107 Walter Rd., North Olmsted, OH (US) 44070

( * ) Notice: Subject to any disclaimer, the term of this patent is extended or adjusted under 35 U.S.C. 154(b) by 0 days.

(21) Appl. No.: 10/746,922

(22) Filed: Dec. 24, 2003

(51) Int. Cl.[7] ..... E04H 15/02
(52) U.S. Cl. ..... 135/96; 108/50.12
(58) Field of Search ..... 135/87, 88.01, 135/96, 121; 108/33, 50.11, 50.12, 90

(56) References Cited

U.S. PATENT DOCUMENTS

| | | | | | |
|---|---|---|---|---|---|
| 2,341,672 | A | * | 2/1944 | Terrill | 108/42 |
| 3,233,618 | A | * | 2/1966 | Ferrier | 108/42 |
| 3,744,500 | A | * | 7/1973 | Briggs | 135/140 |
| 5,311,813 | A | * | 5/1994 | Fairbanks et al. | 99/645 |
| 5,425,753 | A | * | 6/1995 | Wege et al. | 607/83 |
| 5,555,903 | A | * | 9/1996 | Rizzotti | 135/16 |
| 5,579,797 | A | * | 12/1996 | Rogers | 135/90 |
| 6,152,461 | A | * | 11/2000 | Dunks | 280/30 |
| 6,499,411 | B2 | * | 12/2002 | Brown | 108/90 |
| 2002/0144633 | A1 | * | 10/2002 | Brown | 108/90 |
| 2003/0106471 | A1 | * | 6/2003 | Rivers | 108/90 |

FOREIGN PATENT DOCUMENTS

FR 1084050 * 1/1955

* cited by examiner

*Primary Examiner*—James O. Hansen
(74) *Attorney, Agent, or Firm*—Michael I. Kroll

(57) ABSTRACT

A table top tent with two base structures (12), each having a plurality of cylindrical receptacles (14) and means for fastening a strap (18) at each distal end whereby the strap can encompass an end of a table (20) is disclosed. The straps (18) have mating lengths of hook and loop material (26) positioned thereon as means for fixedly holding the tightened strap (18) together. The base structures (12) are used to hold the bottom portion of the canopy (24) support poles (22). The top portions of the poles (22) are attached to the weather resistant canopy (24) having pockets (36) to accommodate the horizontal poles (28). The canopy (24) can be provided in a variety of color and prints. A storage bag is also provided for storing the disassembled components.

11 Claims, 14 Drawing Sheets

PORTABLE TABLE TOP TENT

BACKGROUND OF THE INVENTION

Field of the Invention

The present invention relates generally to table top tent coverings and, more specifically, to a table top tent consisting of two base structures, each having a plurality of cylindrical stems and means for fastening a strap at each distal end whereby said strap can encompass an end of the table. The straps have lengths of hook and loop material positioned thereon with mating members of hook and loop material positioned on each distal end which can be selectively fastened to the mating member as means for fixedly holding the tightened strap. The base structures are used to hold the bottom portion of the canopy support poles. The top portions of the poles are attached to the weather resistant canopy having pockets to accommodate the poles. The canopy can be provided in a variety of colors and prints. A storage bag is also provided for storing the disassembled components.

The table top tent of the present invention is erected above a table top to provide shade, prevent sun glare, protect from falling debris, provide shelter from light rain or drizzle and protected open foods from spoilage due to direct sun light. The tabletop tent of the present invention is easily assembled and disassembled and is easily stored or transported. The device can be used in the back yard, camping trip, hunting and fishing trips, beach, park, pool side or any where an out-doors table is set up. The canopy portion of the table top tent of the present invention when set upon a tabletop reaches out to the sides on the angled poles, covering any persons seated at the table.

While other tabletops tents may be suitable for the purposes for which they were designed, they would not be as suitable for the purposes of the present invention, as hereinafter described. The tabletop tent of the present invention consisting of base structures, each having support stanchions and strap receiving slots. The slots allow a strap to be fixedly attached to the base so the base can be fastened to the table. Each strap has lengths of hook and loop with mating hook and loop material positioned on the distal end providing fastening means for the base structures. The top portions of the poles are attached to pockets within the canopy of weather resistant fabric. The canopy can be provides in a variety of colors and prints. A convenient storage bag is also provided.

SUMMARY OF THE PRESENT INVENTION

The present invention discloses a table top tent with two base structures, each having a plurality of cylindrical receptacles and means for fastening a strap at each distal end whereby the strap can encompass an end of a table. The straps have mating lengths of hook and loop material positioned thereon as means for fixedly holding the tightened strap together. The base structures are used to hold the bottom portion of the canopy support poles. The top portions of the poles are attached to the weather resistant canopy having pockets to accommodate the horizontal poles. The canopy can be provided in a variety of colors and prints. A storage bag is also provided for storing the disassembled components.

A primary object of the present invention is to provide a portable structure that can be mounted to a table to provide shelter from the elements.

Another object of the present invention is to provide a portable structure that when mounted to a tabletop will extend over those seated at said table.

Yet another object of the present invention is to provide a portable structure that can be easily attached to any sized table.

Still yet another object of the present invention is to provide a portable structure having a canopy comprised of a pliable water-resistant material.

Yet another object of the present invention is to provide a portable structure having a canopy with sleeves extending longitudinally for housing support elements therein.

Still yet another object of the present invention is to provide a plurality of poles forming a support structure for said canopy.

Another object of the present invention is to provide a base structure for receiving the support elements for said canopy.

Yet another object of the present invention is to provide apertures on each distal end of said base structure for receiving a strap providing means for releasably fastening said base structure to a table.

Still yet another object of the present invention is to provide a strap having hook and loop material fastened thereto with mating members of hook and loop material positioned on each distal end.

Another object of the present invention is to provide a portable structure comprised of a base structure that is fastened to a table by encompassing the table top with a strap and extending the strap distal ends through the base structure apertures and pulling the ends until the desired tension is achieved whereupon the distal ends having hook and loop material are mated with the mating members of hook and loop material fixedly attached to said strap.

Yet another object of the present invention is to provide a base structure releasably fastened to a table top having receiving members positioned thereon whereby poles can be mounted thereto forming a support structure for said canopy.

Still yet another object of the present invention is to provide a canopy having poles located within canopy sleeves and wherein said poles have means positioned on each distal end for attaching said canopy poles to the poles of the support structure.

Another object of the present invention is to provide a table top tent that secures to the top of an out-door table providing shelter from falling debris, sun glare and provides shade from direct sun exposure and certain rain conditions.

Yet another object of the present invention is to provide a tabletop tent that can be provided in a variety of colors and pattern prints.

Still yet another object of the present invention is to provide a table top tent that is assembled and disassembled and stored within a provided storage bag that is easily and conveniently stowed away when not in use.

Additional objects of the present invention will appear as the description proceeds.

The present invention overcomes the shortcomings of the prior art by providing a table top tent consisting of two base structures, each having three cylindrical posts and two slots. The slots allow a strap to be fixedly attached to the base so the base can be fastened to the table. Each strap consists of hook and loop strips for a secure fit. The base posts are used to hold the bottom portion of three cylindrical poles. The center most stem and pole are vertical and the other two are angled. The top portion of the poles are attached to the canopy of weather resistant fabric and consists of pockets to accommodate the poles. The canopy can be provided in a variety of colors and prints. A convenient storage bag is also provided.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

List of Reference Numerals

Figure 1:
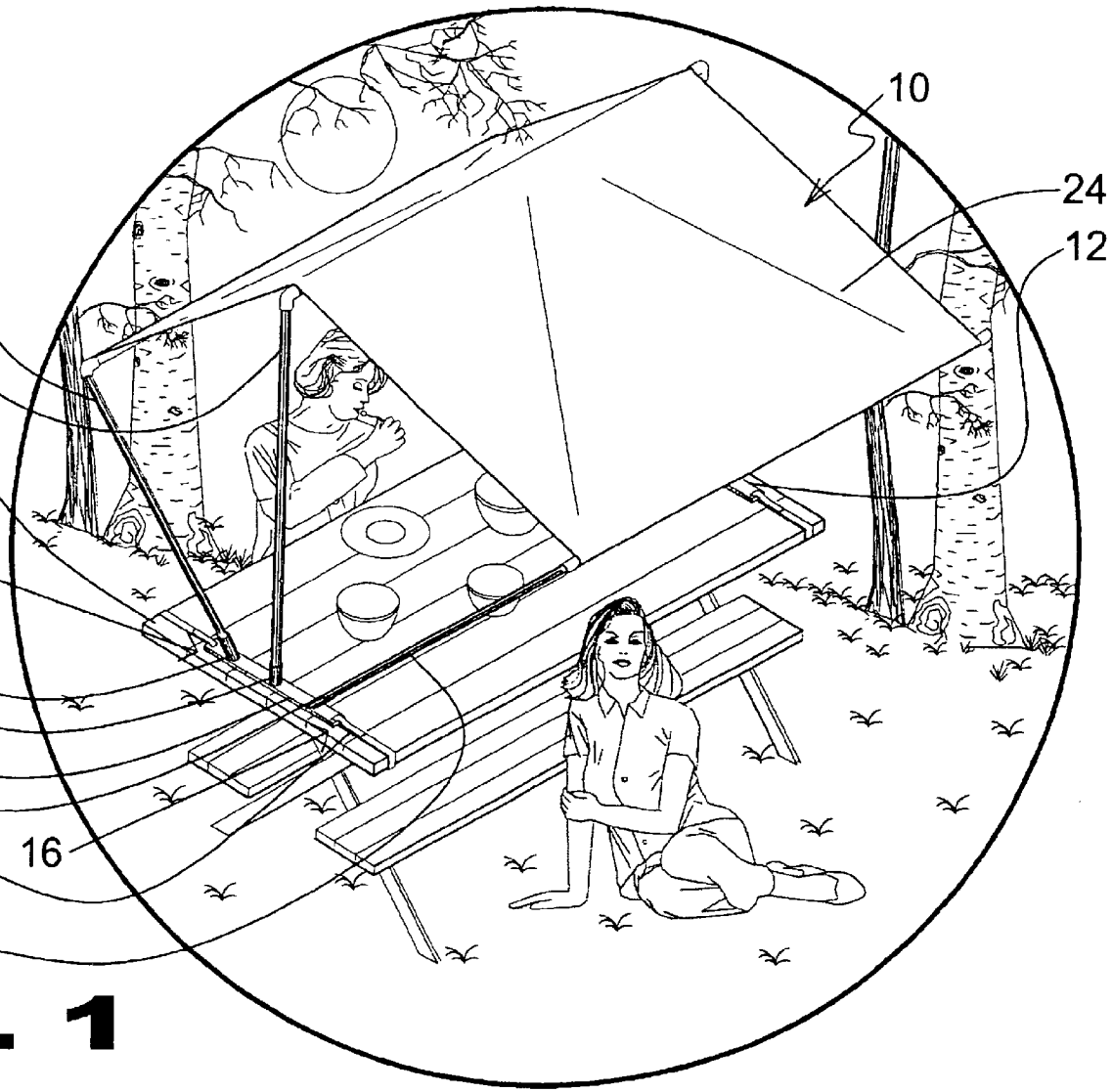
FIG. 1 is an illustrative view of the present invention in use.

With regard to reference numerals used, the following numbering is used throughout the drawings.

10 table top tent 10 of the present invention

12 base structure

14 post receptacle

16 slot

18 strap

20 table

22 upright pole

24 canopy

26 hook and loop fasteners

28 horizontal pole

30 pocket of canopy

32 elbow

34 sewn area

36 fasteners

38 edge.

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the table top tent 10 of the present invention in use. The table top tent 10 of the present invention discloses a tabletop tent which includes two base structures 12 each having three cylindrical post receptacles 14 and two slots 16 which base structures 12 are disposed on the ends of the table top. The slots 16 allow a strap 18 to be fixedly attached to the base 12 so the base can be fastened to the table 20. The strap 18 has lengths of hook and loop positioned thereon so that mating members of hook and loop material are positioned on each distal end which can be selectively fastened to the mating portion as means for fixedly holding the tightened strap. The base post receptacles 14 are used to hold the bottom portion of three cylindrical upright poles 22. The center-most stem and pole are substantially vertical and the other two are angled. The top portion of the poles 22 is attached to the canopy 24 made of weather resistant fabric and consists of pockets to accommodate the poles 22. The canopy 24 can be provided in a variety of colors and prints. A convenient storage bag is also provided.

Figure 2:
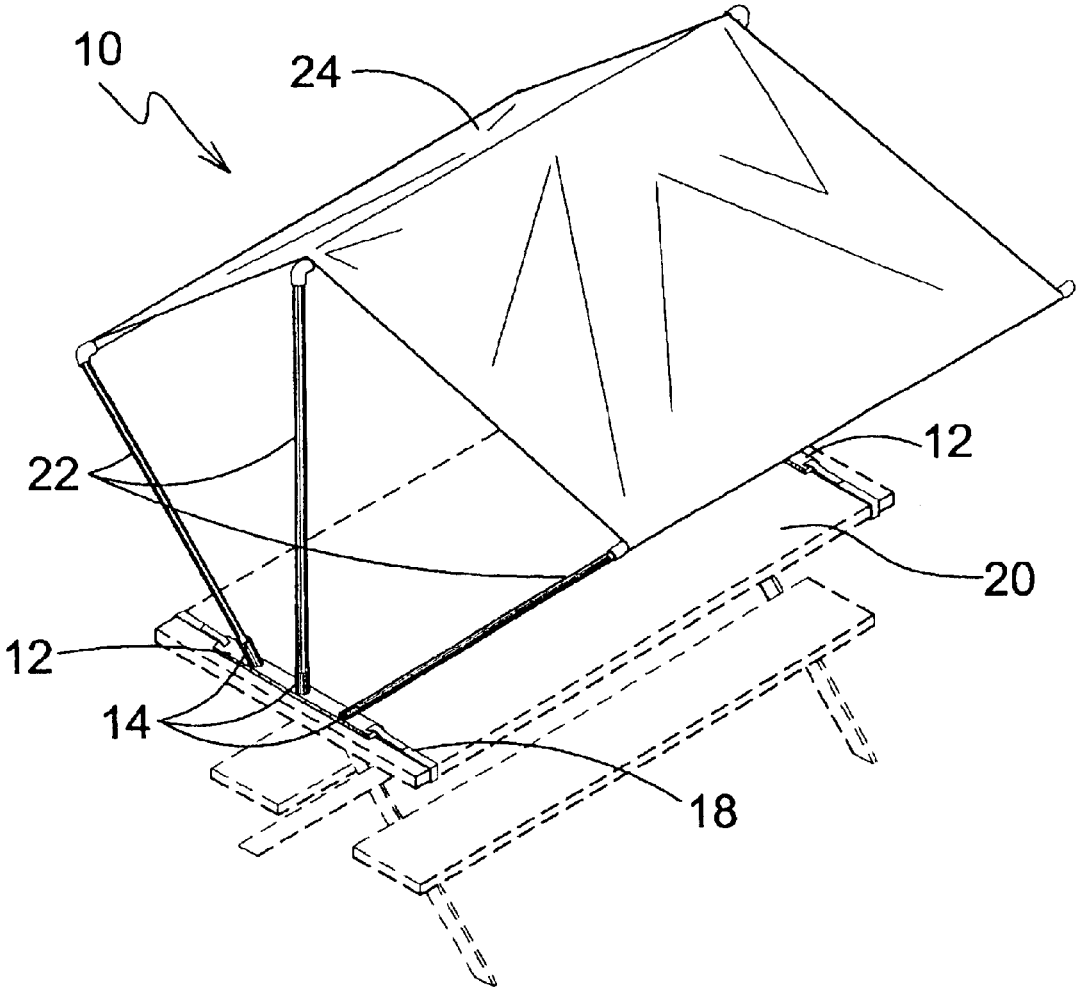
FIG. 2 is a perspective view of the present invention mounted to a table.

Turning to FIG. 2, shown therein is a perspective view of the table top tent 10 mounted to a table 20. The tabletop tent 1*a* of the present invention discloses two base structures 12 each having three cylindrical post receptacles 14 and two slots. The slots allow a strap 18 to be fixedly attached to the base 12 so the base can be fastened to the table 20. Each strap 18 consists of hook and loop strips for a secure fit. The base post receptacles 14 are used to hold the bottom portion of three cylindrical poles 22. The centermost stem and pole are substantially vertical and the other two are angled. The top portion of the poles 22 are attached to the canopy 24 of weather resistant fabric and consist of pockets to accommodate the poles.

Figure 3:
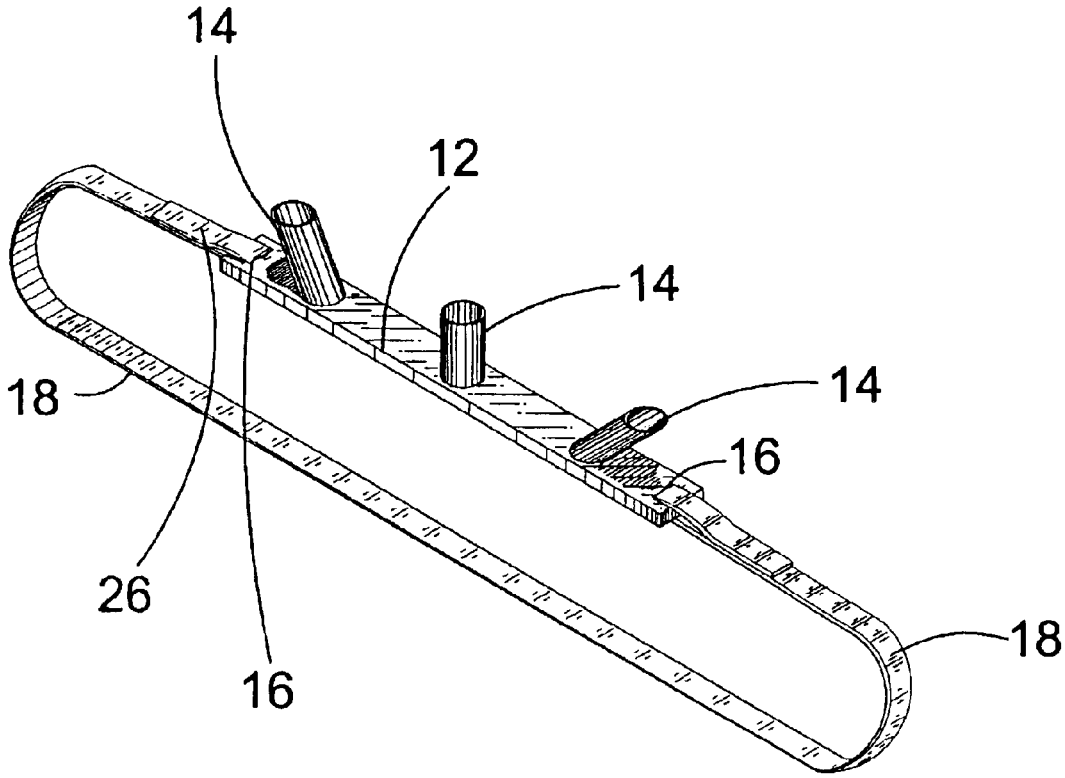
FIG. 3 is a perspective view of the base portion of the present invention.

Turning to FIG. 3, shown therein is a perspective view of the base portion 12 of the table tap tent 10. As shown, the base structure 12 includes three posts 14, two of which are angled and one vertical, with a strap 18 attached to the base unit with slots 16 for receiving straps 18 with hook and loop fasteners 26 on the ends thereof.

Figure 4:
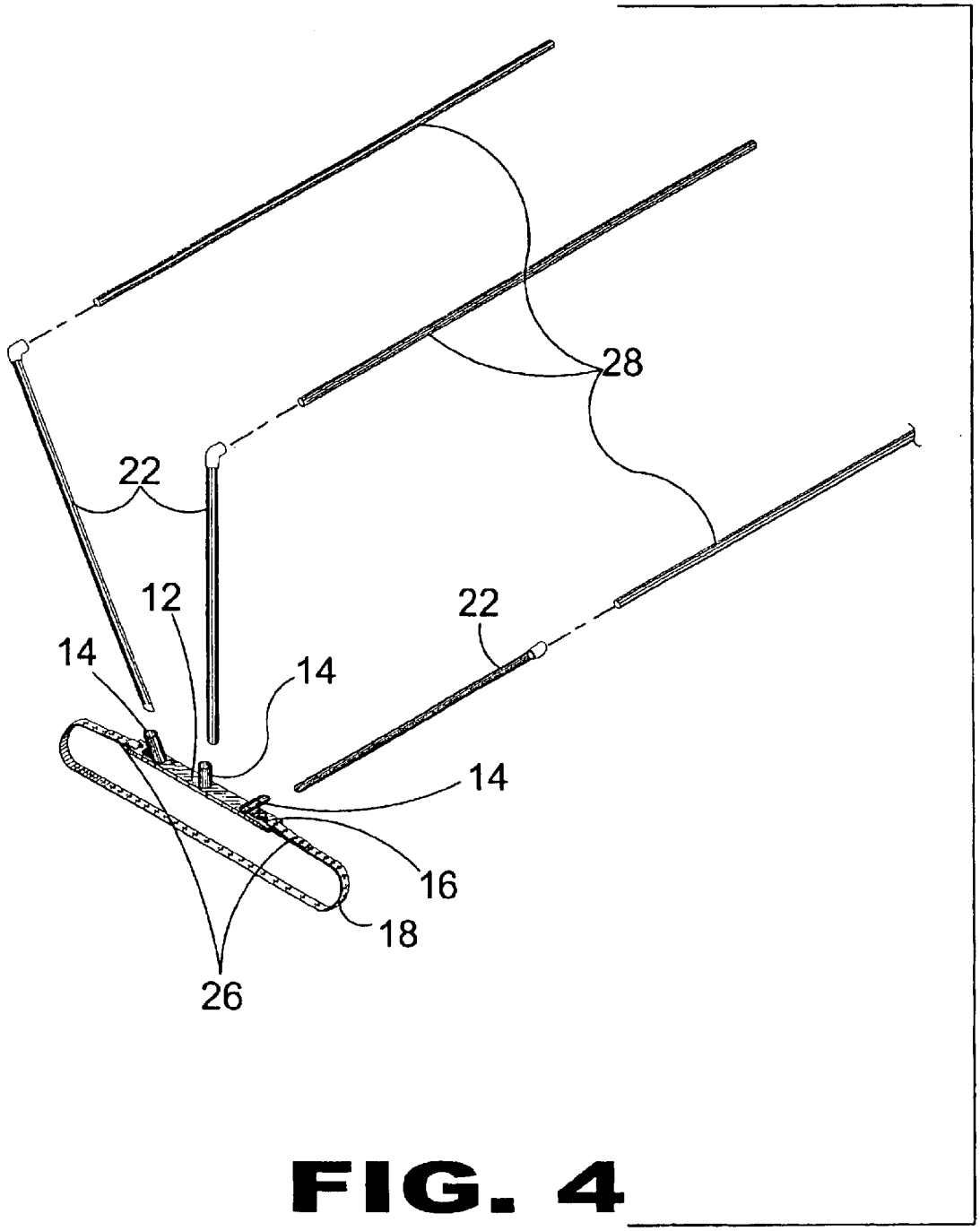
FIG. 4 is a perspective view of the present invention.

Turning to FIG. 4, shown therein is a perspective view of the table top tent 10. The base structure 12 includes three posts 14, two of which are angled and one vertical, with a strap 18 attached to the base unit. Three generally upright poles 22 are inserted within the posts 14 and three horizontal poles 28 attach as shown. Also shown are slot 16 and the hook and loop fastener 26.

Figure 5:
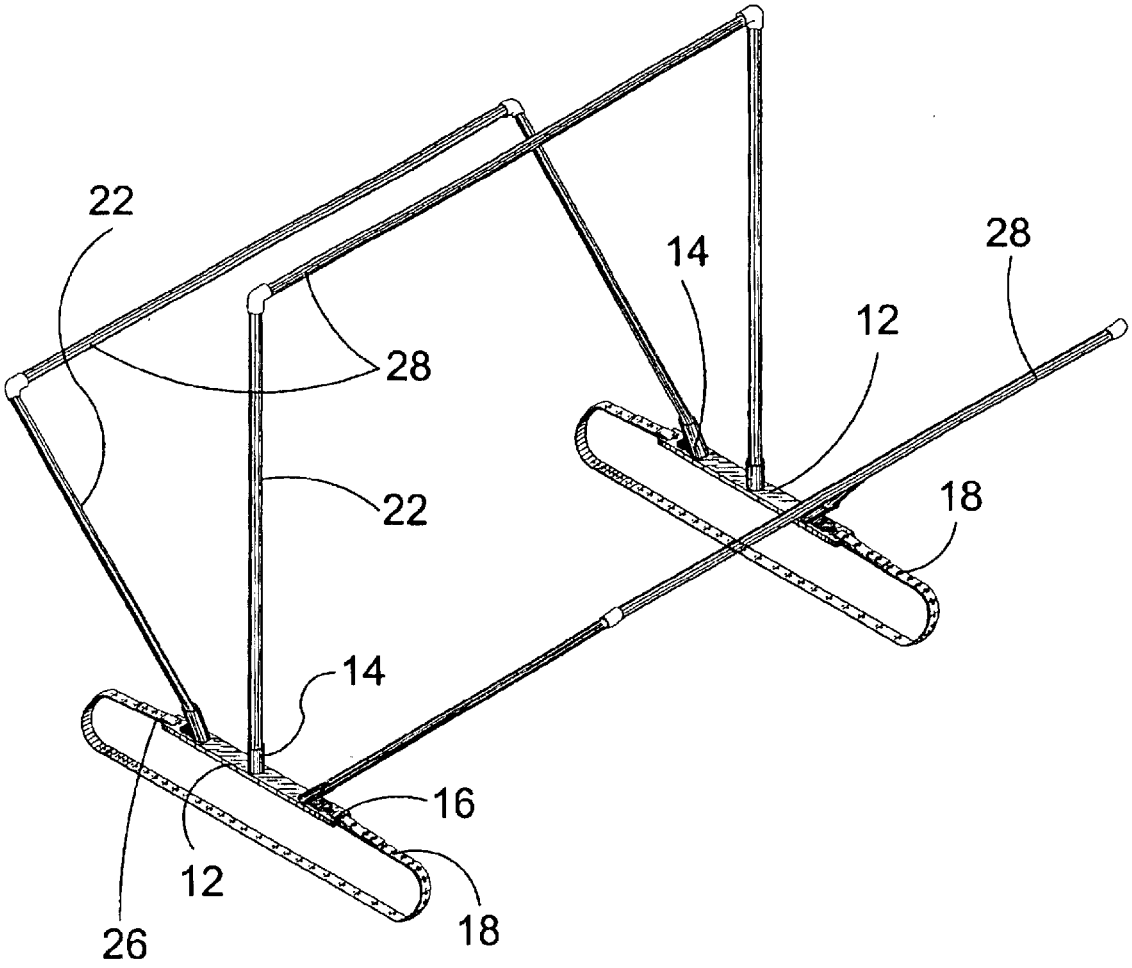
FIG. 5 is a perspective view of the present invention assembled without canopy.

Turning to FIG. 5, shown therein is a perspective view of the table top tent 10 assembled without canopy. The two base structures 12 each include three posts 14, two of which are angled and one vertical, with straps 18 attached to the base units. Three generally upright poles 22 are inserted within the posts 14 and three horizontal poles 28 attach as shown. Also shown are slot 16 and the hook and loop fastener 26.

Figure 6:
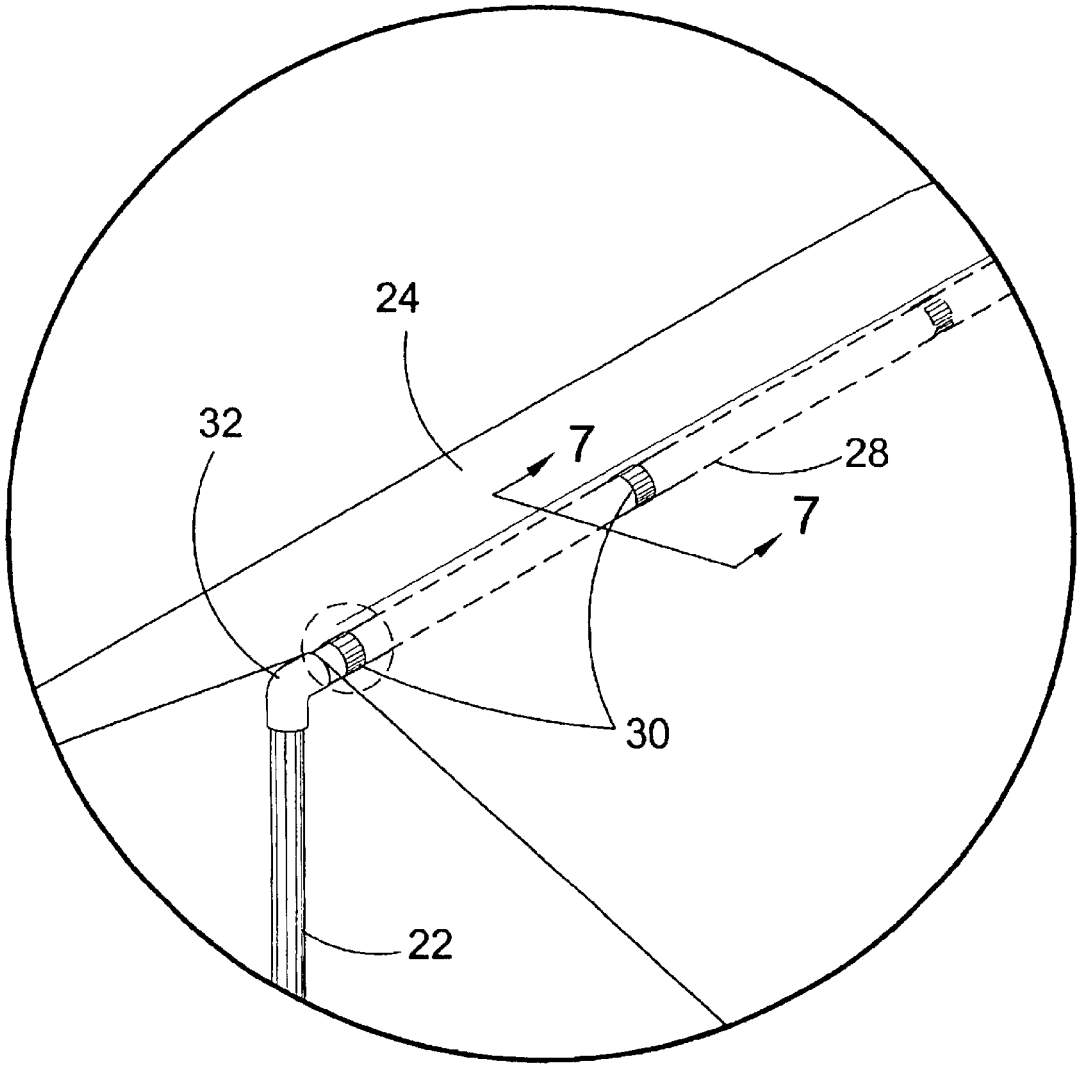
FIG. 6 is a detail view of the present invention's canopy pockets.

Turning to FIG. 6, shown therein is a detail view of the canopy pockets 30 of the table top tent 10. Shown is a view of the canopy 24 pockets 30 and poles 28 therein. The horizontal pole 28 slides through the canopy's pockets 30 joining to the upright pole 22 by means of a pole elbow 32.

Figure 7:
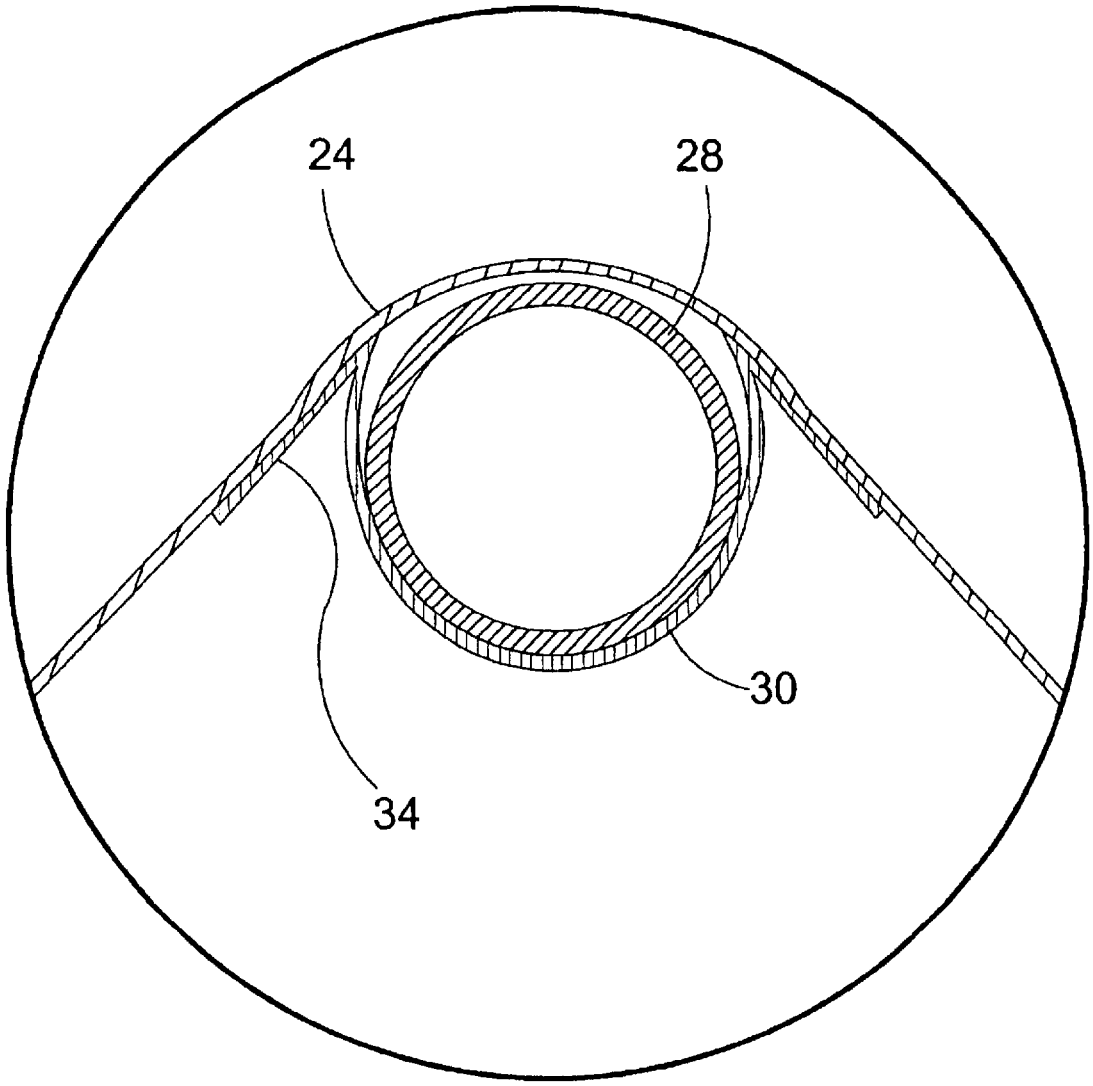
FIG. 7 is a sectional view of the present invention's canopy pockets.

Turning to FIG. 7, shown therein is a sectional view of the canopy pockets 30 of the table top tent 10. Shown is a view of the canopy pockets 30 and poles 28 therein. The pole 28 is shown resting in the canopy pocket 30. The canopy pocket 30 is attached to the inside of the canopy 24 by the method of sewing 34.

Figure 8:
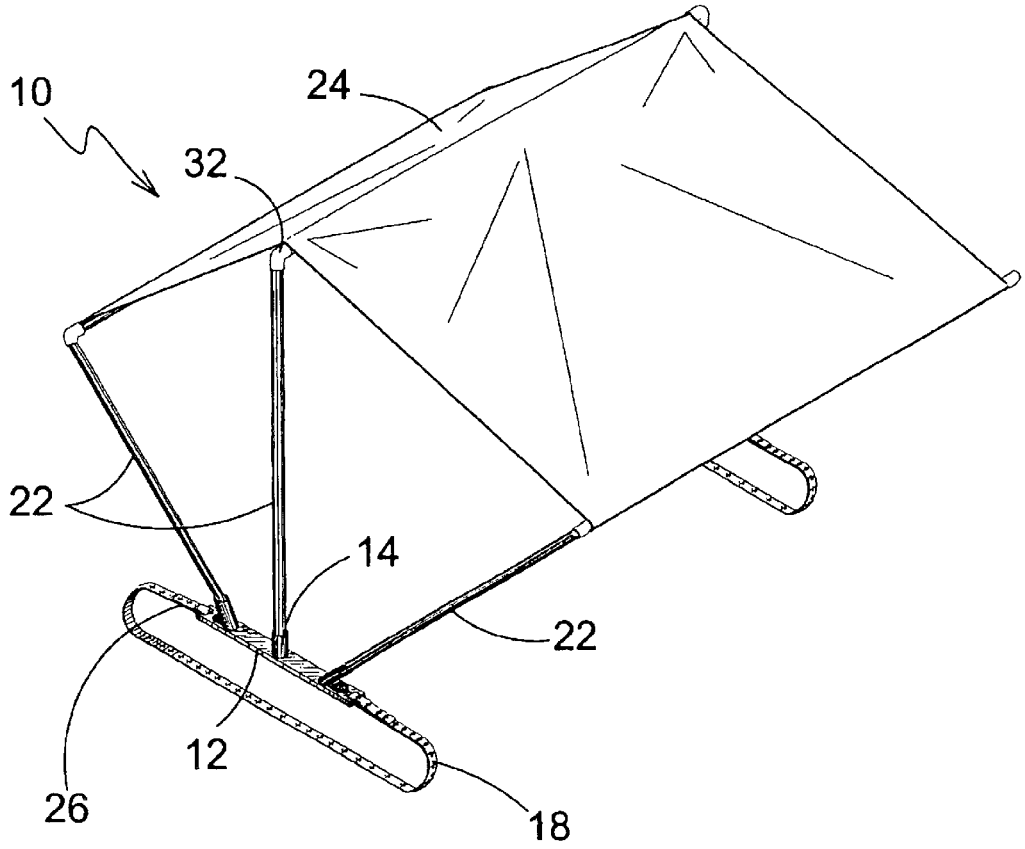
FIG. 8 is a perspective view of the present invention assembled.

Turning to FIG. 8, shown therein is a perspective view of the table top tent 10 assembled. The tabletop tent 10 of the present invention includes two base structures 12 each having three cylindrical posts 14 and two slots. The slots allow a strap 18 to be fixedly attached to the base 12 so the base can be fastened to the table. Each strap 18 includes hook and loop strips 26 for a secure fit. The base posts 14 are used to hold the bottom portion of three cylindrical poles 22. The center most stem and pole are vertical and the other two are angled. The top portion of the poles is attached to the canopy 24 of weather resistant fabric and consists of pockets to accommodate the poles. Also shown is elbow 32.

Figure 9:
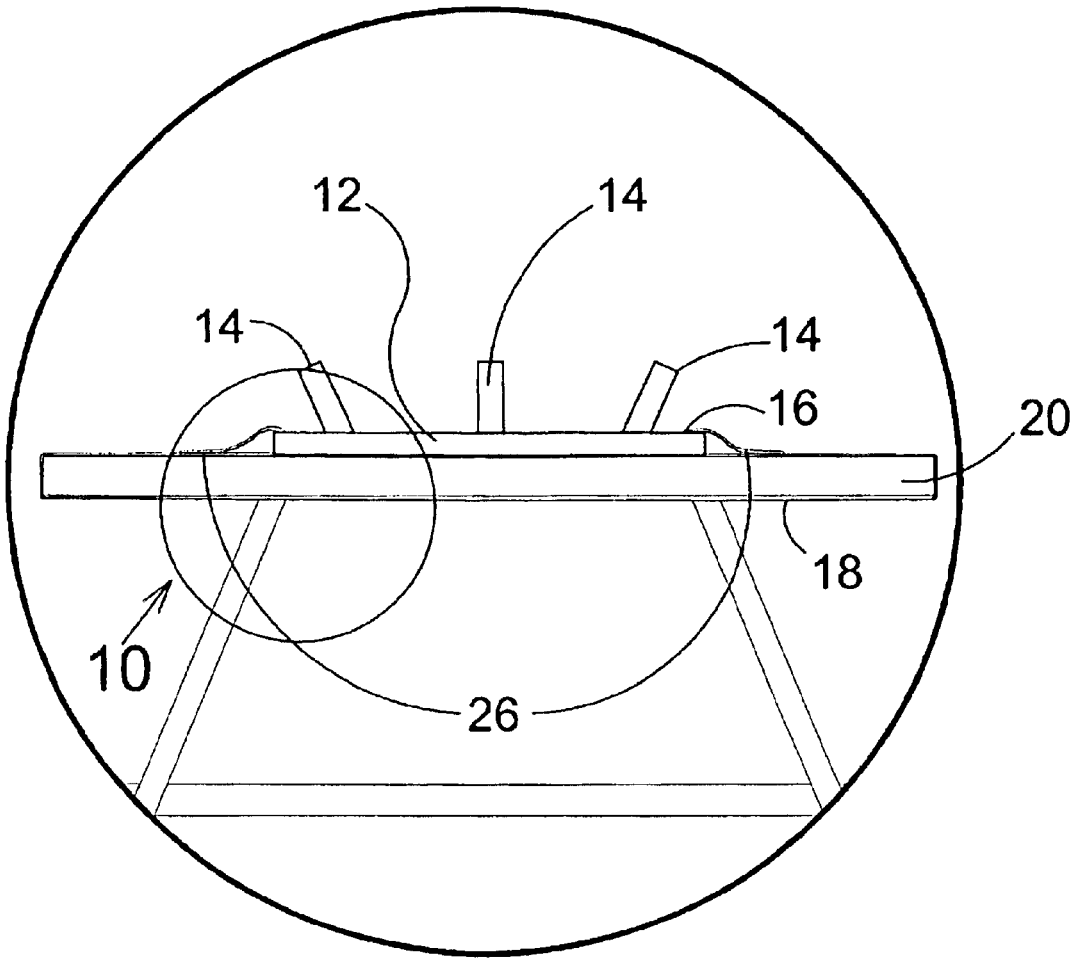
FIG. 9 is a frontal view of the present invention's base.

Turning to FIG. 9, shown therein is a frontal view of the base 12 of the table top tent 10. The tabletop tent 10 of the present invention includes a base structure 12 having three cylindrical posts 14 and two slots 16. The slots 16 allow a strap 18 to be fixedly attached to the base 12 so the base can be fastened to the table 20. Each strap 18 includes hook and loop strips 26 for a secure fit. The base posts 12 are used to hold the bottom portion of three cylindrical poles.

Figure 10:
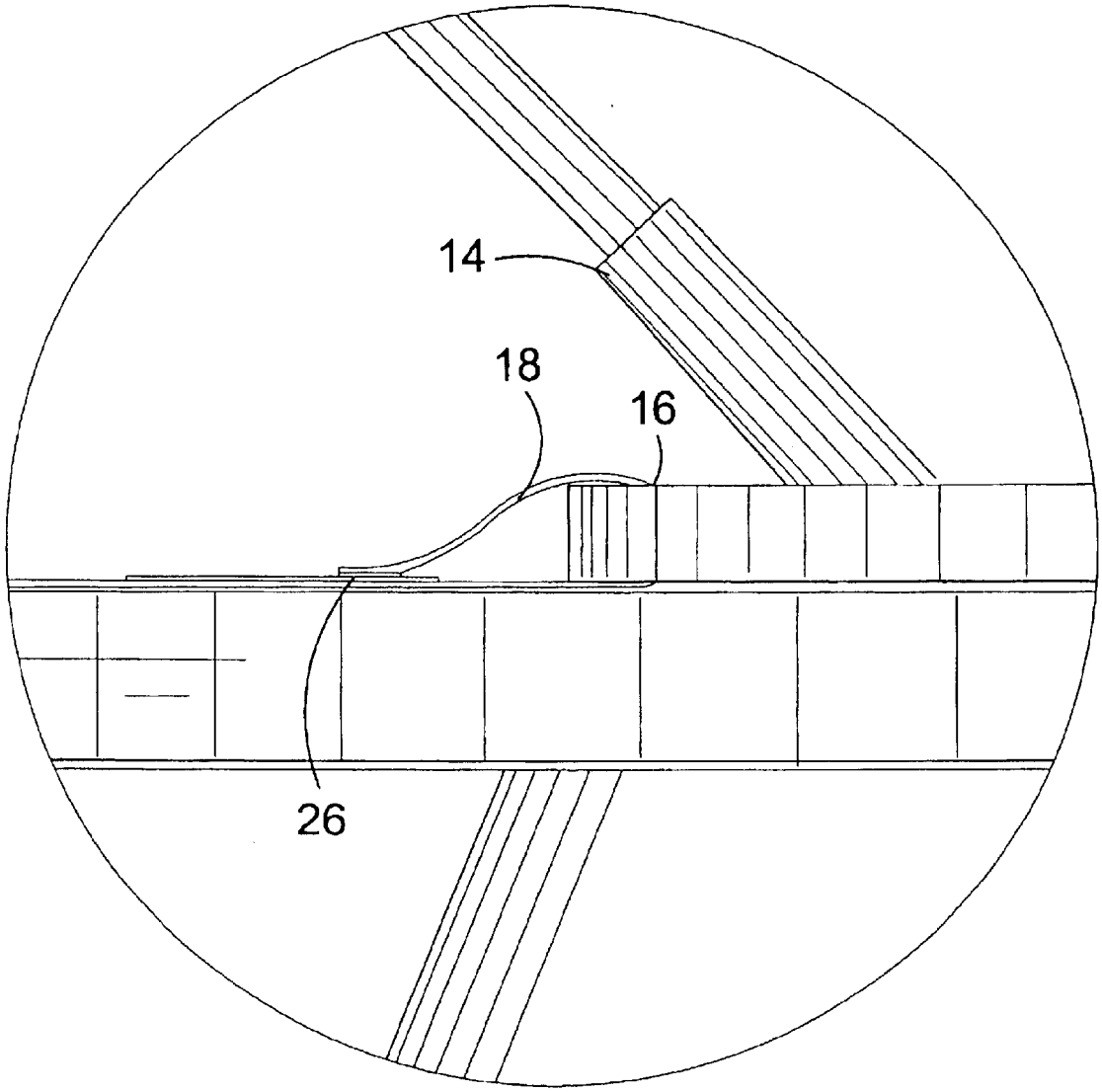
FIG. 10 is a detail view of the hook and loop fastener of the present invention.

Turning to FIG. 10, shown therein is a detail view of the hook and loop fastener 26 of the table top tent 10. Shown is the strap 18 looped through the base's slot 16 and attaching to itself by the mating of the hook and loop fasteners 26 on the end. The fasteners 26 are either sewn or glued on to the strap 18. Angled post 14 is also shown.

Figure 11:
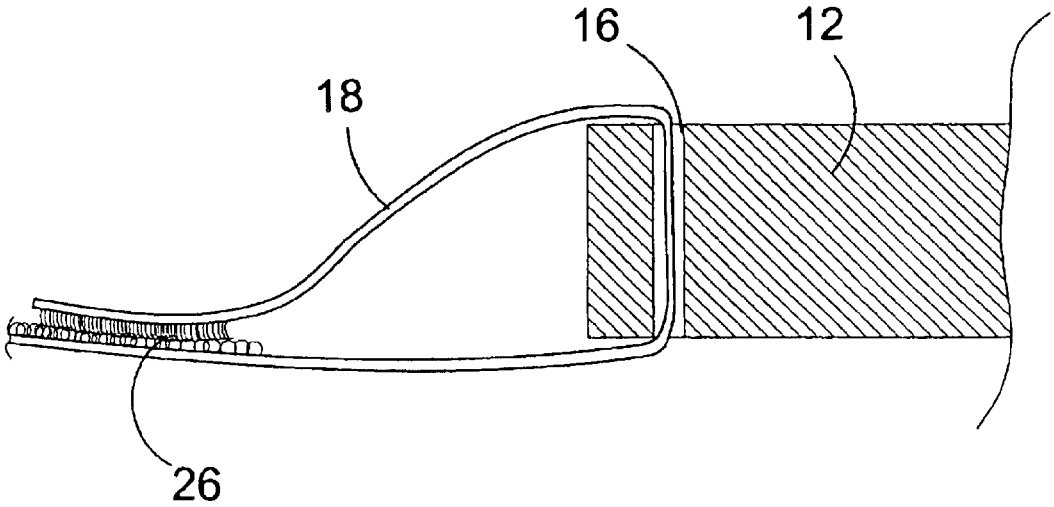
FIG. 11 is a sectional view of the hook and loop fastener of the present invention.

Turning to FIG. 11, shown therein is a sectional view of the hook and loop fastener 26 of the table top tent 10. Shown is the strap 18 looped through the base 12 slot 16 and attaching to itself by the mating of the hook and loop fasteners 26 on the end. The fasteners 26 are either sewn or glued on to the strap 18.

Figure 12:
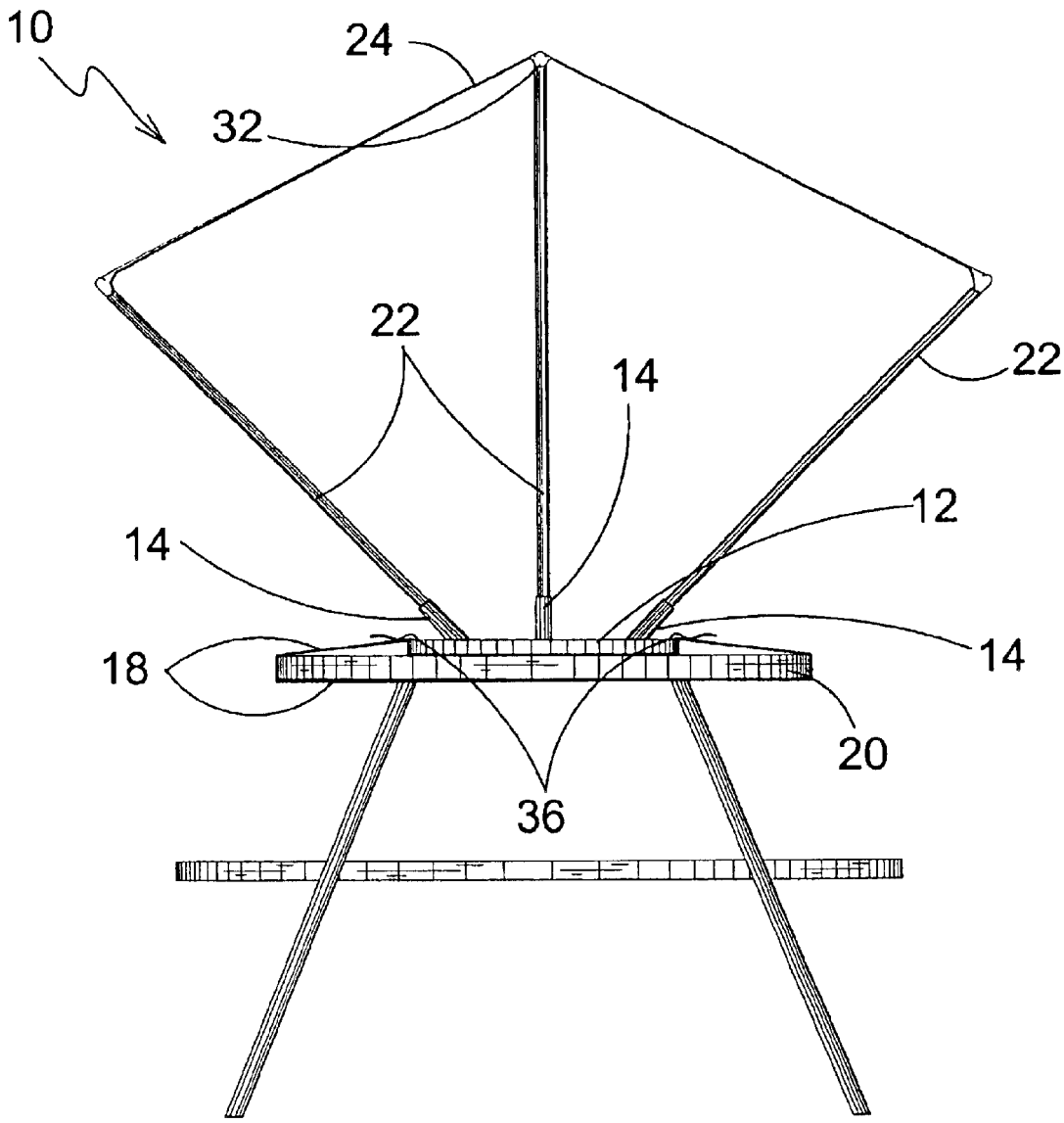
FIG. 12 is a frontal view of an alternate fastening element of the present invention.

Turning to FIG. 12, shown therein is a frontal view of an alternate fastening element of the table top tent 10. The tabletop tent 10 of the present invention includes two base structures 12 each having three cylindrical posts 14 and three slots. The slots allow a strap 18 to be fixedly attached to the base 12 so the base can be fastened to the table 20. The strap 18 is looped through a frictional buckle like fastener 36 incorporated into the base 12. The base posts 14 are used to hold the bottom portion of three cylindrical poles 22. The centermost stem and pole 22 are vertical and the other two are angled. The top portion of the poles is attached to the canopy 24 of weather resistant fabric and consists of pockets to accommodate the poles. Elbow 32 is also shown.

Figure 13:
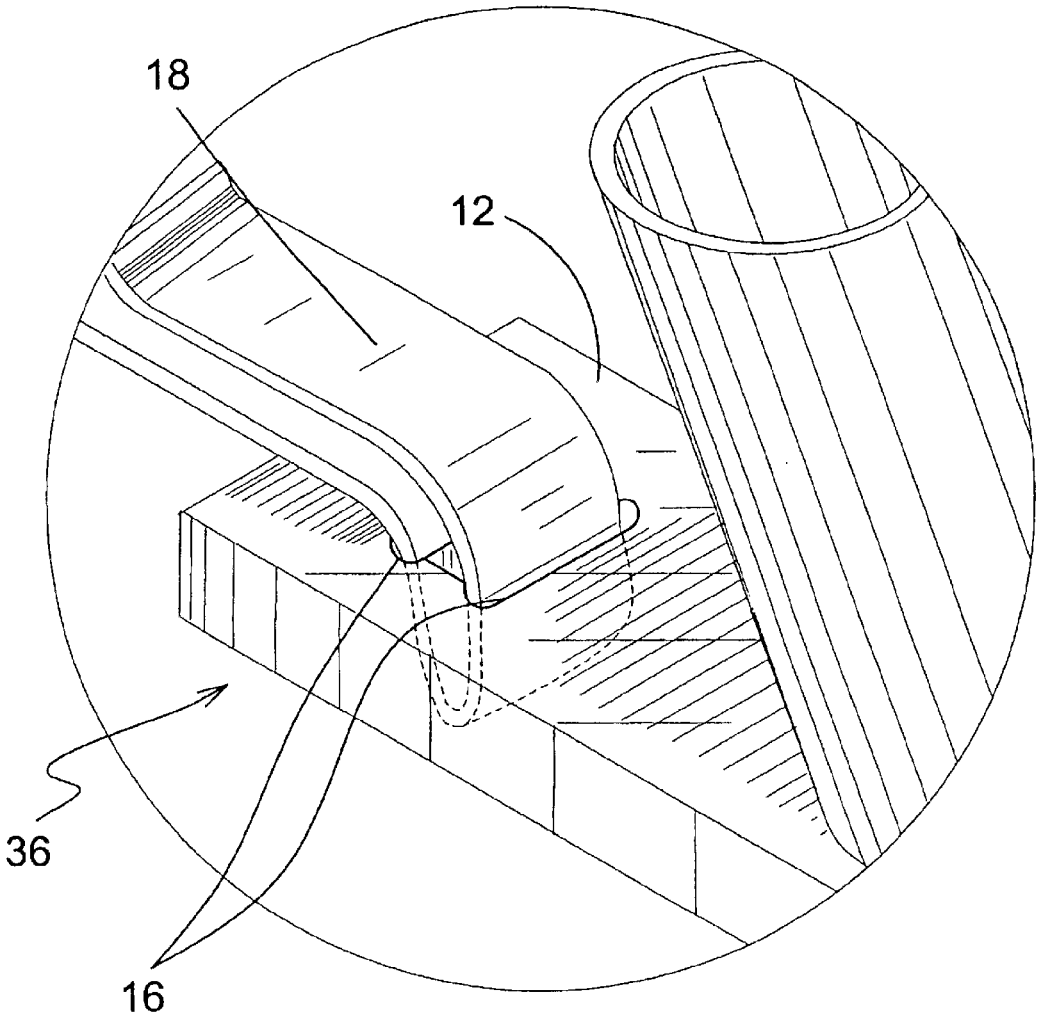
FIG. 13 is an enlarged view of the alternate fastening element of the present invention.

Turning to FIG. 13, shown therein is an enlarged view of the alternate fastening element 36 of the table top tent 10. Shown is an frictional additional fastener 36 of the table top tent 10 which are two adjacent slots 16 located on the base structure 12 end where the strap 18 will feed through creating a loop that will provide a shortening and lengthening adjustment for the strap.

Figure 14:
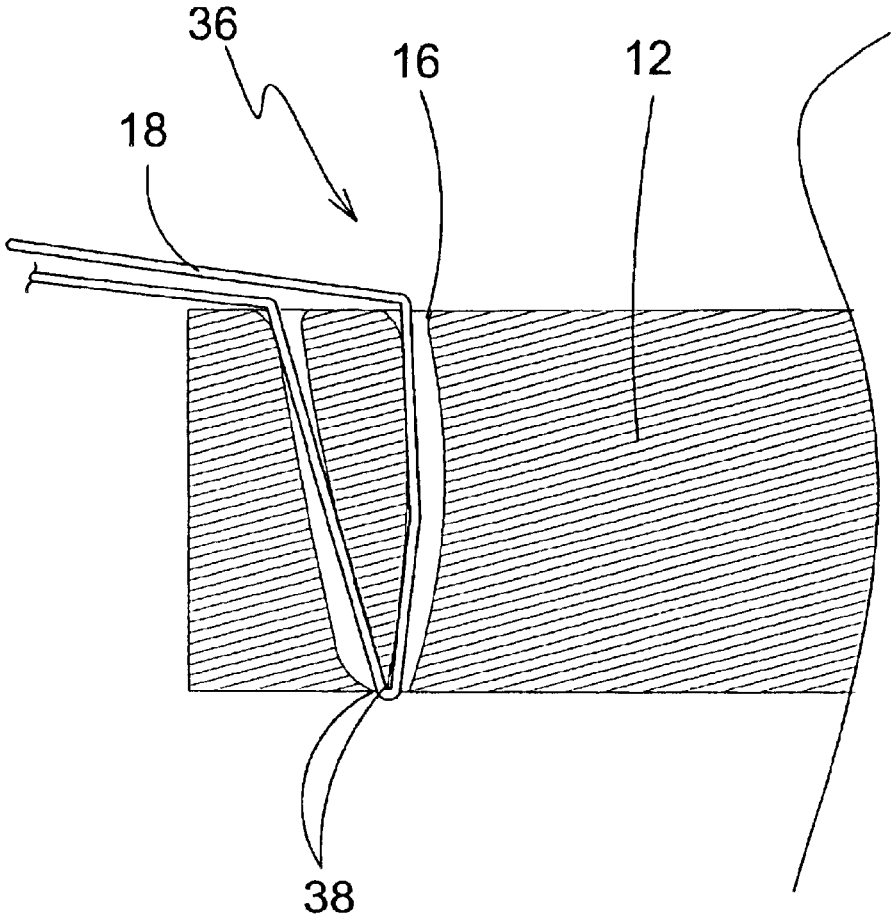
FIG. 14 is a sectional view of an alternate fastener of the present invention.

Turning to FIG. 14, shown therein is a sectional view of an alternate fastener 36 of the table top tent 10. Shown is an additional frictional fastener 36 of the table top tent 10 which are two slots 16 located on the base structure's 12 end where the strap 18 will feed through creating a loop that will provide a shortening, lengthening and position locking adjustment for the strap having a strap frictional locking edge 38 therein.

I claim:

1. A portable canopy for providing a cover for a table, comprising:

a) a table having a table top to permit items to be placed thereon, said table top having a pair of exposed ends to permit the portable canopy to be attached thereto, said table top having a top, a bottom, and a pair of longer and shorter edges;

b) a pair of base members, said base members being elongated having a first and second opposing end, a top and a bottom, said base member having a pair of slots therein, wherein one of each pair of slots is disposed adjacent each end of said base member, wherein one of each said base member is disposed adjacent to one of each said end of said table, wherein said base member is oriented to be substantially perpendicular to said longer edge of said table;

c) means for connecting said pair of base members to said table top whereby the base members are removably secured to the table top;

d) a plurality of receptacles disposed in a spaced apart manner on said top of each of said base members; wherein said receptacles are cylindrical, wherein a first said receptacle is substantially vertically disposed intermediate said base members, wherein a second said receptacle is angled away in the vertical plane from a first side of said first receptacle and a third said receptacle is angled away in the vertical plane from a second opposite side of said first receptacle in the vertical plane;

e) a plurality of first poles, said first poles having first and second opposing ends wherein said first end of one of each of said poles is disposed in one of each said receptacles, wherein one each of said first poles corresponds to one each of said receptacles;

f) a plurality of horizontal poles connecting each of said second ends of said first poles, said horizontal poles each having first and second opposing ends, wherein said first end of each of said horizontal poles connects to said second end of said first poles disposed on a first of said base members, and said second end of each of said horizontal poles connects to a corresponding said second end of said first poles disposed on a second of said base members to permit a canopy to be placed therein;

g) a canopy disposed on said horizontal poles to permit the table to be covered; and, h) means for attaching said canopy to said horizontal poles whereby the canopy can be removably secured to the horizontal poles.

2. The portable canopy of claim 1, wherein said means for connecting said pair of base members to said table top comprises:

a) a pair of straps having first and second opposing ends;

b) wherein said first end of said straps pass through and connect to said slot on said first end of each of said base members and said second end of said straps pass through and connect to said slot on said second end of each of said base members;

c) hook and loop material disposed on said first and second end of said strap, wherein said hook and loop material is matingly disposed on said straps to permit the first and second ends of the straps to pass through the slots and then to mate with the straps; and, d) wherein said straps wrap around said table top to permit the base members to be removably secured to the table.

3. The portable canopy of claim 2, further comprising an elbow member for connecting said first and second ends of said horizontal poles to said second ends of said first poles.

4. The portable canopy of claim 3, wherein aid canopy has an outside and an inside surface and a first and second edge, said first edge disposed above said first base member and said second edge disposed above said second base member;

said canopy further including a plurality of pockets disposed on said inside surface thereof, said pockets extending from said first edge to said second edge of said canopy to permit one each of said horizontal poles to be placed in one each of said pockets; and, wherein one of each said horizontal poles are placed in one of each said pockets to permit the canopy to be attached to the horizontal poles.

5. The portable canopy of claim 4, a) wherein each of said base members have a pair of slots disposed adjacent each other on each of said first and second opposing ends of said base members;

b) a frictional locking edge disposed between each slot of each pair of slots, said frictional locking edge disposed on said bottom of said base member, wherein said locking edge securely grips said straps;

c) wherein said first end of said straps passes through each pair of slots disposed on said first end of said base member, and said second end of said straps passes through each pair of slots disposed on said second end of said base member; and, d) wherein said first and second ends of said straps pass through said pair of slots so that said straps are contiguous to said frictional locking edge to permit the straps to be removably secured to the frictional locking edge and thereby to the base member.

6. The portable canopy of claim 5, wherein there are three of said receptacles, said first poles and said horizontal poles.

7. The portable canopy of claim 6, wherein said first poles are cylindrically shaped.

8. The portable canopy of claim 7, wherein said horizontal poles are cylindrically shaped.

9. The portable canopy of claim 8, wherein said hook and loop material is glued to said first and second end of said straps.

10. The portable canopy of claim 9, wherein said hook and loop material is sewn to said first and second end of said straps.

11. The portable canopy of claim 10, wherein said pockets are sewn to said canopy.

* * * * *